US005775513A

United States Patent [19]

Anthony

[11] Patent Number: 5,775,513

[45] Date of Patent: Jul. 7, 1998

[54] GOLD CLUB HOLDER

[76] Inventor: Larry L. Anthony, 1000 Sutton Pl., Apt. 1021, Horn Lake, Miss. 38637

[21] Appl. No.: 710,566

[22] Filed: Sep. 19, 1996

[51] Int. Cl.[6] ..... A63B 55/00; A63B 55/02

[52] U.S. Cl. ..... 206/315.3; 206/315.5; 206/315.6; 206/315.9

[58] Field of Search ..... 206/315.2–315.6, 206/315.9; 211/70.2

[56] References Cited

U.S. PATENT DOCUMENTS

| | | | |
|---|---|---|---|
| 1,699,048 | 1/1929 | Connor | 206/315.5 |
| 1,829,093 | 10/1931 | Hollins | 206/315.5 |
| 2,879,819 | 3/1959 | Turnbull | 206/315.4 |
| 2,926,713 | 3/1960 | Vaughan | 211/70.2 |
| 2,950,748 | 8/1960 | Olinghouse | 206/315.2 X |
| 3,331,419 | 7/1967 | Bencriscutto . | |
| 3,966,051 | 6/1976 | Hollister et al. | 211/70.2 X |
| 4,173,241 | 11/1979 | Stock . | |
| 4,200,131 | 4/1980 | Chitwood et al. | 206/315.6 |
| 4,245,684 | 1/1981 | Street et al. . | |
| 4,522,299 | 6/1985 | Clark | 206/315.6 X |
| 4,779,725 | 10/1988 | Gerber | 206/315.6 X |
| 5,094,345 | 3/1992 | Yonnetti | 206/315.2 |
| 5,099,990 | 3/1992 | Antonius | 206/315.6 |
| 5,267,660 | 12/1993 | Kwon | 211/70.2 |
| 5,458,340 | 10/1995 | Rich et al. | 206/315.6 X |

FOREIGN PATENT DOCUMENTS

| | | | |
|---|---|---|---|
| 2130102 | 5/1984 | United Kingdom | 206/315.6 |

OTHER PUBLICATIONS

AIM Golf, CROSPETE® Lite Organizer (photocopy of front and back of product tag) (date unknown).

*Primary Examiner*—Sue A. Weaver
*Attorney, Agent, or Firm*—Walker, McKenzie & Walker

[57] ABSTRACT

A golf club holder holds and organizes a plurality of golf clubs within a golf bag. The holder includes a floor portion having a first plurality of holes therethrough, with each hole being sized for receipt of a shaft of a golf club therethrough, and the holder also includes a circumferential sidewall portion extending upwardly from the floor portion and substantially concentric with the central axis of the floor portion. A second plurality of wedge-shaped compartments are formed within the sidewall portion with each compartment being shaped as an annular sector about the central axis, being downwardly closed by the floor portion, and having an open apex radially inward toward the central axis. The heads of golf clubs are received into the compartments when the shafts of the clubs are received into the holes through the floor portion. Raised platform portions separate some of the compartments, and a vertical bore through each raised platform portion receives the shaft of an oversize golf club. Tubes extend downwardly from the floor portion and the shafts of the golf clubs are received within the downwardly-extending tubes. A rubber grommet is sandwiched to the floor portion by a plate, and fingers on the grommet retain the golf club shafts within the various holes and bores. A golf ball dispenser may also be provided, and a cover may be used over the golf club holder.

29 Claims, 6 Drawing Sheets

FIG. 1
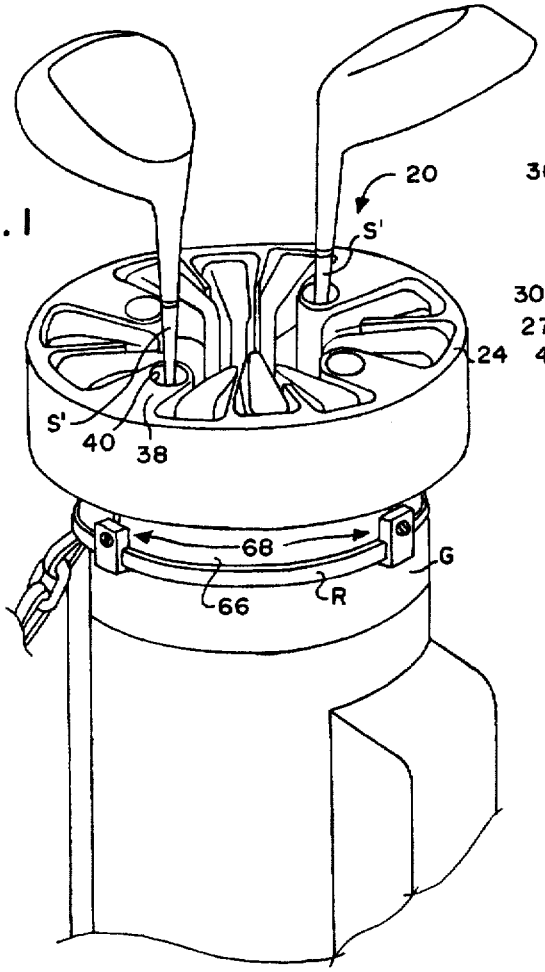
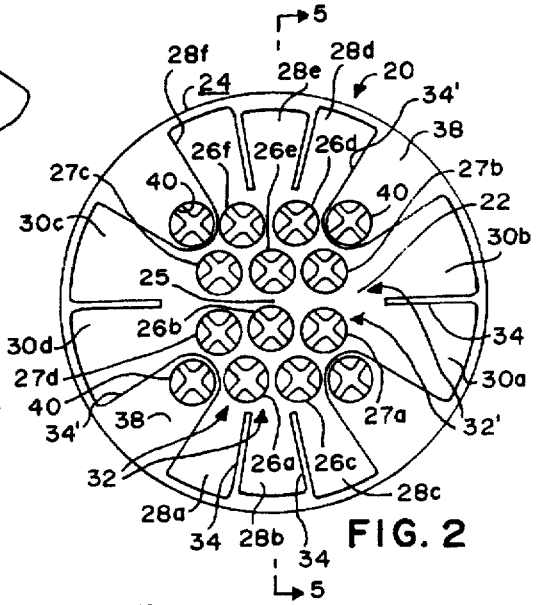
FIG. 2
FIG. 3
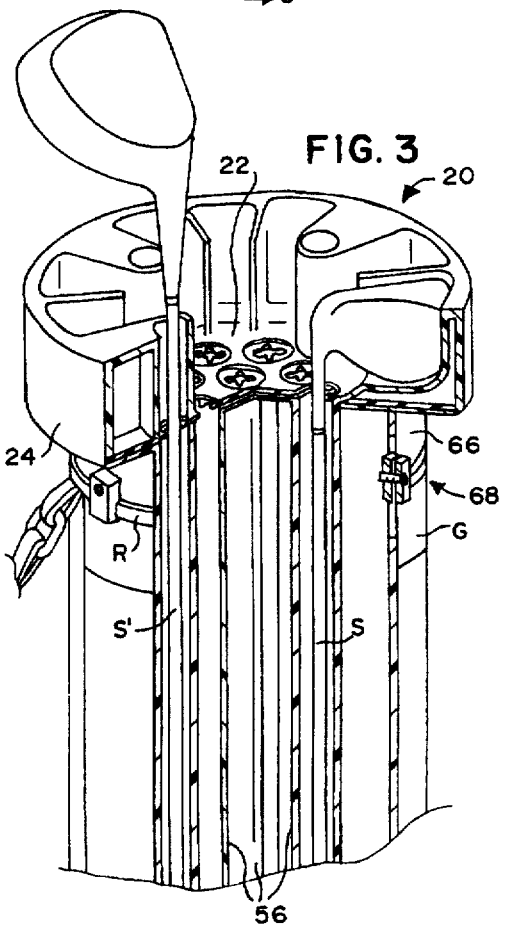
FIG. 4
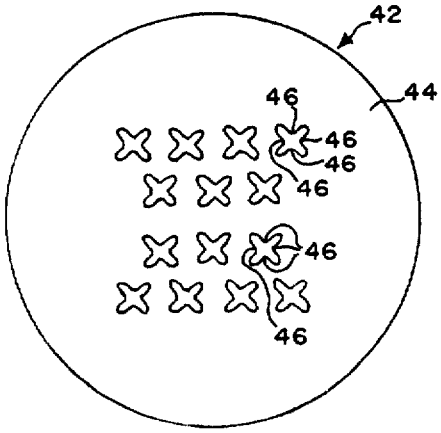

FIG. 10
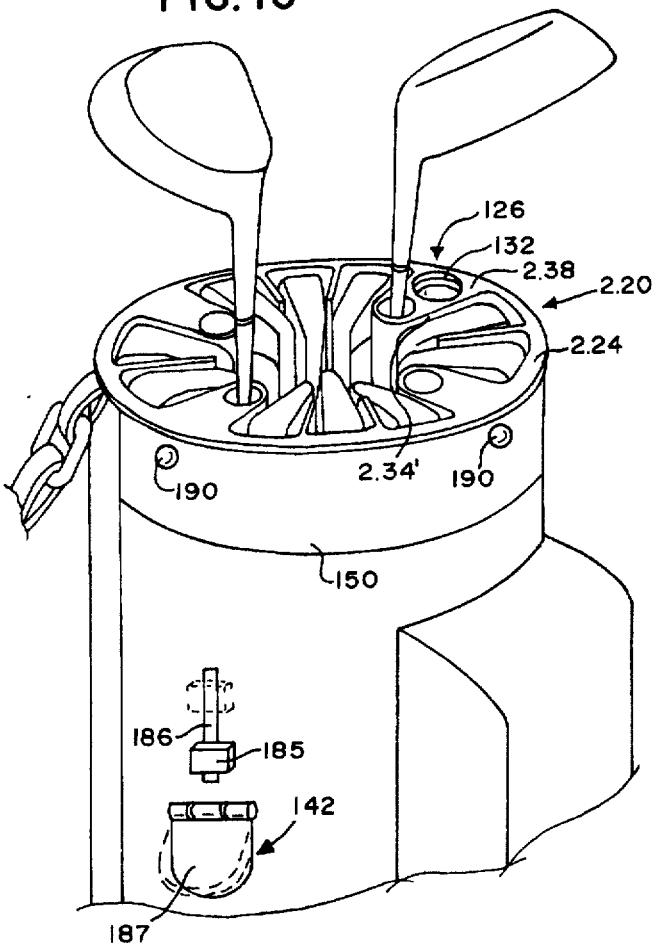
FIG. 11
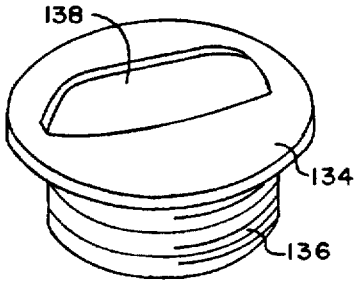
FIG. 12
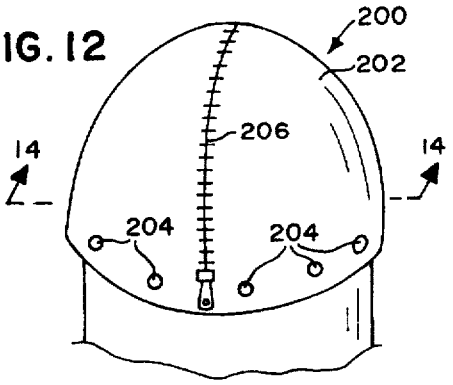
FIG. 13
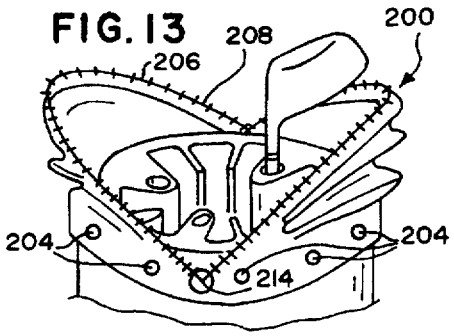
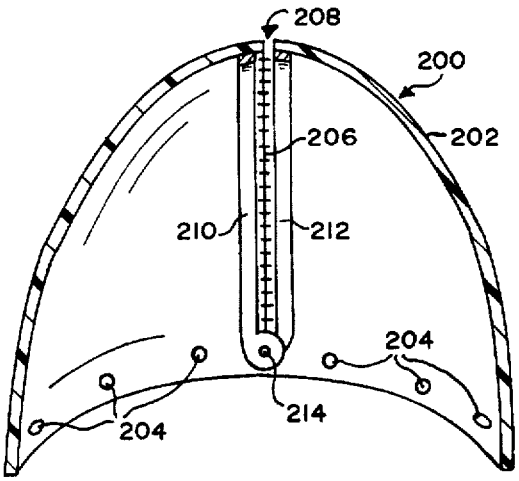
FIG. 14
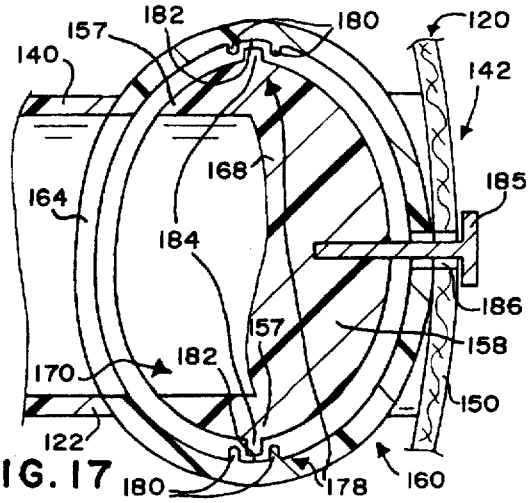
FIG. 17

GOLD CLUB HOLDER

BACKGROUND OF THE INVENTION

1. Field of the Invention

The present invention relates, in general, to sporting goods, and in particular, to golf bags and golf club holders.

2. Information Disclosure Statement

The well-known rules of the game of golf permit a golfer to use fourteen golf clubs while playing a round of golf. Depending on the course conditions and the golfer's preference, the golfer may select, for example, nine different "irons" plus one "wedge" plus four different "drivers" or "woods" or three "drivers" or "woods" and a "putter", or, alternatively, the golfer may select seven"irons" plus three "wedges" plus four "drivers" or "woods" or three "drivers" or "woods" and a "putter", etc., for a total selection of thirteen or fourteen clubs and with the total number of clubs not exceeding fourteen. These golf clubs are typically placed into a golf bag for ease of transport about the golf course.

As the technology and materials used in constructing golf clubs has advanced, extremely high-performance golf clubs have become commonly used. However, such high-performance golf clubs are very expensive, and prior art golf bags, which provide little or no protection for the golf clubs, allow the golf clubs to move freely about within the golf bag and forcibly contact each other, thereby damaging the expensive golf clubs and creating"nicks" and marks on the club heads. A well-known solution to this problem is to provide separate socklike or tie-on covers for the head of each golf club, but such a solution is cumbersome, the covers can be difficult to use, and the covers often become lost.

It is therefore desirable to provide a golf club holder that protects and retains the heads of golf clubs during transport of the clubs in a golf bag so as to prevent the clubs and club heads from forcibly contacting one another, and also so as to minimize noise that would otherwise result from rattling of the golf clubs in the golf bag. It is further desirable to provide a golf club holder that organizes golf clubs within a golf bag so as to provide easy selection of the desired club by a golfer, and that does not require the use of cumbersome covers for the heads of the golf clubs.

A preliminary patentability search in Class 206, subclasses 315.5 and 315.6, produced the following patents, some of which may be relevant to the present invention: Bencriscutto, U.S. Pat. No. 3,331,419, issued Jul. 18, 1967; Stock, U.S. Pat. No. 4,173,241, issued Nov. 6, 1979; Street etal., U.S. Pat. No. 4,245,684, issued Jan. 20, 1981; Yonnetti, U.S. Pat. No. 5,094,345, issued Mar. 10, 1992; and Antonius, U.S. Pat. No. 5,099,990, issued Mar. 31, 1992.

Additionally, applicant is aware of a golf bag sold under the trademark CROSPETE and having retaining holders into which various golf club shafts are received. Unlike the present invention, the CROSPETE golf bag allows the heads of the irons to swing freely and forcibly contact one another and provides no compartments into which the heads of the irons are received, thereby allowing the clubs to become damaged by this unrestrained mutual contact.

None of these references disclose or suggest the present invention.

SUMMARY OF THE INVENTION

The present invention is a golf club holder having several embodiments, all of which organize golf clubs within a golf bag and protect the golf clubs from forcibly contacting each other.

The golf club holder comprises a floor portion having a plurality of holes therethrough, with each of the holes being sized for receipt of the shaft of a golf club, and with the floor portion having a substantially central axis. A circumferential sidewall portion extends upwardly from the floor portion, substantially concentric with the central axis, and has a plurality of wedge-shaped compartments formed therewithin about the central axis. Each wedge-shaped compartment is preferably shaped as an annular sector about the central axis, being downwardly closed by the floor portion, upwardly open for receiving the head of a golf club therewithin, and having an open apex radially inward toward the central axis. Each wedge-shaped compartment is in substantial radial alignment with a different one of the holes through the floor portion so that a golf club may be placed into the holder with the shaft of the club extending into the respective hole and with the head of the club being received into the respective compartment. The golf club holder may include raised platform portions, interposed between some of the wedge-shaped compartments, each platform portion having a vertical bore therethrough, and the shaft of the golfer's "woods" may be received into and through the vertical bore. A plurality of tubes may extend downwardly, one from each of the holes in the floor portion and one from each of the vertical bores, so as to receive and protect the shafts of the golf clubs, with resilient retaining means, such as a rubber grommet, retaining the shafts of the golf clubs within the various holes and bores. A golf ball dispenser may also be included with the golf club holder. One embodiment of the invention is an insert for placement into an existing golf bag, and another embodiment is constructed integral with the golf bag.

It is an object of the present invention to provide a golf club holder that protects golf clubs and the heads of the golf clubs without requiring separate covers for the heads of each of the clubs, and also to provide a golf club holder that reduces the objectionable noise caused by club-to-club contact that heretofore has been produced as golf clubs are carried about a golf course in a golf bag. It is a further object of the present invention to organize golf clubs within a golf bag so as to permit easy removal and replacement of the clubs from and into the golf club holder, and so as to facilitate selection of golf clubs by the golfer during play.

BRIEF DESCRIPTION OF THE DRAWINGS

FIG. 1 is a perspective view of the present invention shown attached to a first type of golf bag.

FIG. 2 is a top plan view of the present invention.

FIG. 3 is a perspective sectional view of the present invention.

FIG. 4 is a top plan view of the grommet pad of the present invention.

FIG. 10 is a perspective view of the second embodiment of the present invention, showing the intake and dispensing ports of the second embodiment of the golf ball dispensing means.

FIG. 11 is a perspective view of the intake plug of the second embodiment of the golf ball dispensing means.

FIG. 12 is a perspective view of a cover for use with the present invention.

FIG. 13 is a perspective view of the cover of the present invention in an opened condition.

FIG. 14 is a sectional view of the cover of the present invention, taken substantially along the line 14—14 shown in FIG. 12.

FIG. 17 is a top sectional view of the second embodiment of the golf ball dispensing means, taken substantially along the line 17—17 shown in FIG. 16 and with the golf balls removed for clarity.

DESCRIPTION OF THE PREFERRED EMBODIMENTS

Figure 5:
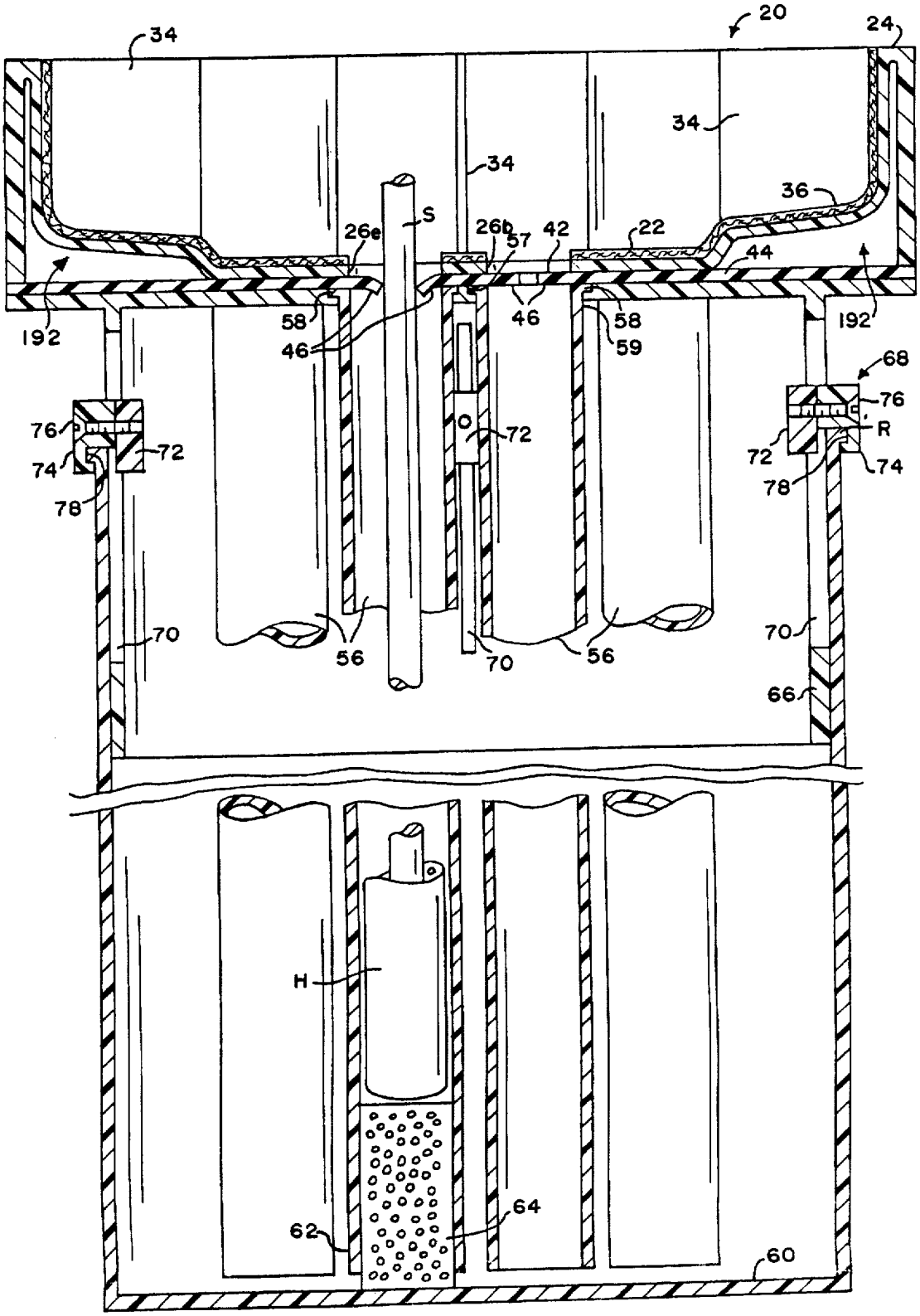
FIG. 5 is a side sectional view of the present invention showing attachment to a golf bag, with the section being taken along a diameter of the invention, such as along the line 5—5 shown in FIG. 2.
Figure 6:
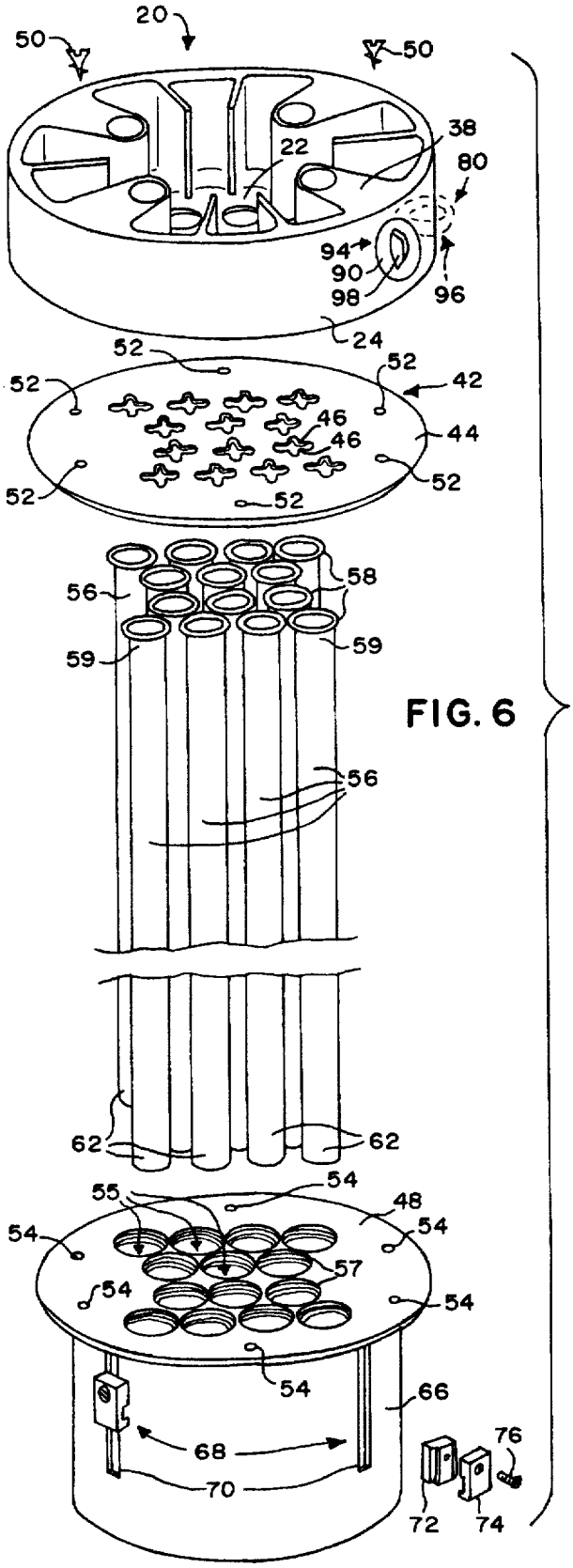
FIG. 6 is an exploded perspective view of the present invention showing the various parts thereof.
Figure 7:
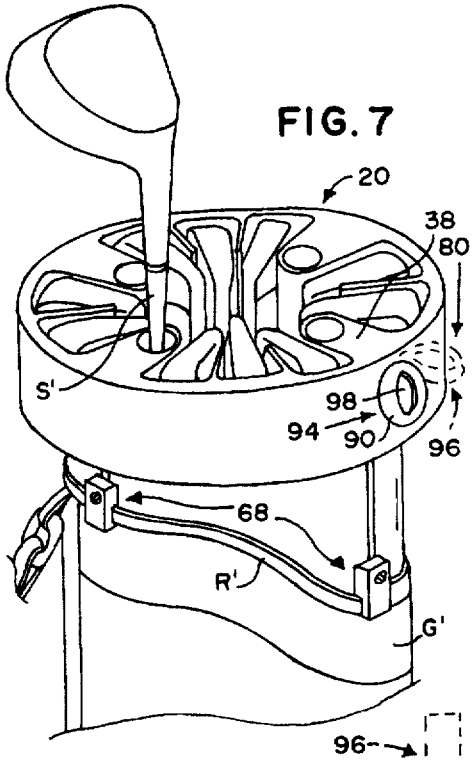
FIG. 7 is a perspective view of the present invention shown attached to a second type of golf bag.
Figure 8:
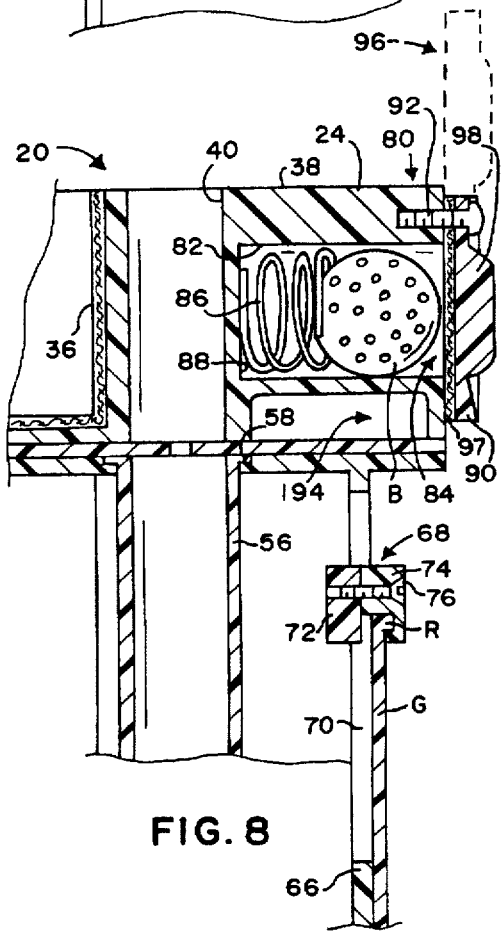
FIG. 8 is a partial sectional view of the present invention, showing a first embodiment of the golf ball dispensing means.

Referring to FIGS. 1–8, the first embodiment of golf club holder 20 is seen to comprise a floor portion 22 and a circumferential sidewall portion 24 extending upwardly from floor portion 22. Golf club holder 20 is received within and secured to a well-known golf bag G in a manner hereinafter described. Preferably, both floor portion 22 and sidewall portion 24 are substantially circular and concentric with each other about a substantially central axis 25.

Floor portion 22 has a first plurality of holes, e.g., 26*a*, 26*b*, 26*c*, 26*d*, 26*e*, 26*f*, and 27*a*, 27*b*, 27*c*, and 27*d*, therethrough. Each hole 26*a*-26*f* and 27*a*-27*d* is radially sized for receipt of a shaft S of a well-known first golf club, such as a "wedge" or an "iron", therethrough, including being sized for receipt therethrough of the well-known enlarged handgrip H that is typically present on such a golf club's shaft.

Sidewall portion 24 extends upwardly from floor portion 22 substantially concentric with the central axis of floor portion 22, and sidewall portion 24 has a second plurality, preferably ten in number, of wedge-shaped compartments, e.g., 28*a*, 28*b*, 28*c*, 28*d*, 28*e*, 28*f*, 30*a*, 30*b*, 30*c*, and 30*d*, formed radially therewithin about the central axis. Each wedge-shaped compartment 28*a* -28*f* and 30*a*-30*d* is preferably shaped substantially as an annular sector about the central axis as best seen in FIG. 2. Each wedge-shaped compartment 28*a*-28*f* and 30*a*-30*d* is downwardly closed by floor portion 22 and has an open apex 32, 32' radially inward toward the central axis 25 of the floor portion 22, and each wedge-shaped compartment 28*a*-28*f* and 30*a*-30*d* is upwardly open as shown. The number of wedge-shaped compartments is no greater than, and is preferably equal to, the number of holes 26*a*-26*f* and 27*a*-27*d*, .i.e., with one hole corresponding to each compartment, and the apex of each compartment is in substantial radial alignment with a different hole through floor portion 22, e.g., with the respective apexes of compartments 28*a*, 28*b*, 28*c*, 28*d*, 28*e*, 28*f*, 30*a*, 30*b*, 30*c*, and 30*d* respectively being in substantial radial alignment with holes 26*a*, 26*b*, 26*c*, 26*d*, 26*e*, 26*f*, 27*a*, 27*b*, 27*c*, and 27*d*. Each wedge-shaped compartment is preferably sidewardly bounded by and separated from each other compartment by raised radial divider walls 34, 34'.

Each wedge-shaped compartment 28*a*-28*f* and 30*a*-30*d* is sized and adapted for receiving a head of a golf club, e.g., a "wedge" or an"iron", therewithin, as shown especially in FIG. 1, when the shaft of each different golf club is respectively received into the various different holes 26*a*-26*f* and 27*a* -27*d* through floor portion 22. Preferably, four of the wedge-shaped compartments, i.e., compartments 30*a*, 30*b*, 30*c*, and 30*d*, are somewhat larger along their angular dimension about the central axis 25 so as to receive the larger "wedge" clubs, whereas six of the wedge-shaped compartments, Le., compartments 28*a*, 28*b*, 28*c*, 28*d*, 28*e*, 28*f*, are somewhat smaller than compartments 30*a*-30*d*, because these smaller compartments are intended to hold the smaller "iron" clubs. All wedge-shaped compartments 28*a*-28*f* and 30*a*-30*d* are preferably lined with padding 36 such as felt or soft cloth so as to cushion and protect the heads of the golf clubs received therewithin, and the padding 36 preferably extends throughout the entire interior of sidewall portion 24 and over floor portion 22 as shown especially in FIG. 5, with appropriate cutout holes therethrough in alignment with holes 26*a*-26*f* and 27*a*-27*d*. Padding 36 is secured, in a manner well-known to those skilled in the art, as with glue or preferably using well-known interlocking fasteners such as those sold under the trademark VELCRO, to floor portion 22 and sidewall portion 24. By preferably securing padding 36 to floor portion 22 and sidewall portion 24 using interlocking fasteners, padding 36 may be easily removed when soiled, then washed and replaced back into the golf club holder 20. Padding 36 also serves to dampen noise of the clubs held within the golf club holder 20.

Interposed between some of the wedge-shaped compartments is a third plurality, preferably four, of raised platform portions 38 formed within sidewall portion 24, each raised platform portion 38 being formed from an enlarged and widened divider wall 34' separating two adjacent wedge-shaped compartments and, like the wedge-shaped compartments, each raised platform portion 38 is preferably shaped as a substantially annular sector about the central axis 25 of floor portion 22. Each raised platform portion 38 preferably has its upper surface co-planar with the top of sidewall portion 24 and the top of narrow divider walls 34, and each raised platform portion 38 further preferably has a substantially vertical bore 40 therethrough, with each bore 40 being radially sized for receipt of a shaft S' of a second golf club, such as a "wood" or a "driver", therethrough, including being sized for receipt therethrough of the well-known enlarged handgrip H that is typically present on such a golf club. The vertical bore 40 of each respective raised platform portion 38 is preferably oriented at the apex of raised platform portion 38 toward the central axis 25 of floor portion 22.

A typical diameter dimension for each of the holes 26*a*-26*f* and 27*a*-27*d* and bores 40 would be approximately one inch (2.54 cm) so as to allow passage of the enlarged handgrip H of a golf club therethrough. Preferably the holes 26*a*-26*f* and 27*a*-27*d* and the vertical bores 40 are arranged in a four-row grid as shown in FIG. 2, with the vertical bores 40 being at the outer ends of the top and bottom rows, i.e., at the four corners of the grid, so as to closely pack the clubs within golf club holder 20 while still spacing the club heads and shafts one from the other so as to avoid mutual contact. With such a structure, the golf club holder 20 can hold the mandatory thirteen or fourteen clubs in a compact arrangement, preferably in clockwise numerical order, thereby permitting the clubs to be quickly and easily selected, removed from the golf club holder and replaced thereinto by the golfer during play.

Golf club holder 20 preferably includes resilient retaining means 42 for retaining the shafts S, S' of the golf clubs within the respective holes 26*a*-26*f* and 27*a*-27*d* and vertical bores 40. Preferably, retaining means 42 comprises a rubber grommet 44, preferably 1/16 inch (1.6 mm) to 1/8 inch (3.2 mm) in thickness and having a comparable radial dimension as floor portion 22, with grommet 44 having a multiplicity of fingers 46 respectively extending into each of the holes and bores. In addition to retaining the golf club shafts within the respective holes and bores, the fingers 46 of grommet 44 also act to minimize the noise that might otherwise occur were the golf club shafts to be permitted to freely move about within the various holes and bores.

Golf club holder 20 further preferably includes a plate 48 secured to and below floor portion 22, as, for example, using screws 50 threadedly inserted through floor portion 22, through holes 52 in grommet 44, and being threadedly received into holes 54 in plate 48, with grommet 44 thus being sandwiched between plate 48 and floor portion 22 and with fingers 46 in substantial alignment with holes 26*a*-26*f* and 27*a*-27*d* and vertical bores 40. Screws 50 are preferably threadedly inserted through floor portion 22 and tightened into threaded holes 54 in plate 48 before padding 36 is applied to floor portion 22, thereby enabling padding 36 to conceal the heads of screws 50 from view.

Golf club holder 20 further preferably includes, for each hole 26*a*-26*f* and 27*a*-27*d* and each bore 40, a tube 56 extending downwardly from floor portion 22 in substantial axial alignment with the respective holes and bores. Each tube 56 preferably has an outwardly-extending lip 58 therearound at its proximal end 59, and plate 48 has, for each hole 26*a*-26*f* and 27*a*-27*d* and each bore 40 and in substantial vertical alignment therewith, an orifice 55 therethrough, with each respective orifice 55 having an upwardly-enlarged mouth 57 entrappingly receiving lip 58 of the respective tube 56 therewithin. By such a structure, each tube 56 is entrappingly secured to floor portion 22 in substantial alignment with its respective hole or bore for receipt of a golf club's shaft S or S' thereinto. Each tube 56 sized similarly to its respective hole or bore, and preferably has an inner diameter of approximately one inch (2.5 cm) so as to receive the well-known enlarged handgrip H of a golf club therewithin. Alternatively, tubes 56 could be molded as integral, one-piece, with floor portion 22 rather than having lips 58 received within mouths 57.

Each tube 56 preferably extends downwardly toward, and preferably adjacent to and within ½ inch (1.27 cm) of, the bottom 60 of golf bag G, with the length of tube 56, approximately 39.5 inches (1 meter), being selected to match the set of golf clubs used and the height of golf bag G. If desired and as shown in FIG. 5, the open distal end 62, remote from floor portion 22, of some or all of the tubes 56 may have a hard foam insert plug 64 received thereinto so as to permit the enlarged handgrip H to rest upon the insert. Preferably, such foam inserts 64 would only be used in those tubes 56 extending downwardly from bores 40 so as to raise the oversize golf clubs, which are received into bores 40, so that the heads of such oversize golf clubs do not hit the smaller golf clubs received into the wedge-shaped compartments and so that the heads of the oversize golf clubs are above sidewall portion 24.

The first embodiment 20 of the golf club holder preferably includes a cylindrical sleeve body 66 concentric with central axis 25 and extending downwardly from, and preferably integral with, plate 48. Sleeve body 66 is sized for close fitting receipt into golf bag G, having an outer diameter of 8 to 12 inches (approximately 20 to 30 cm) to match the well-known various typical inner diameter of golf bags such as golf bag G. Preferably sleeve body 66 will have a longitudinal length of approximately 18 inches (46 cm) so as to permit the height of the golf club holder 20 above the bottom 60 of the golf bag G to be adjusted, in a manner hereinafter described, for various lengths of golf clubs and heights of golf bags G.

The first embodiment 20 of the golf club holder preferably also includes clip means 68, vertically adjustable with respect to the golf club holder and secured thereto, for securing golf club holder 20 to the rim R or R' of golf bag G or G', respectively. As seen best in FIGS. 5 and 6, clip means 68 preferably comprises a plurality of vertical slots 70 formed within cylindrical sleeve body 66, into each of which are received back and front slidable member portions 72, 74, secured together and retained within the respective slots 70 by a screw 76 that threadedly binds portions 72 and 74 together.

Clip means 68 permits the height of the first embodiment 20 of the golf club holder to be adjusted vertically above the bottom of the golf bag as sleeve body 66 is slidingly vertically adjusted to the correct height within the golf bag. Some well-known golf bags, like golf bag G shown in FIG. 1, have a rim R that circularly surrounds the top of bag G in a plane. Other well-known golf bags, such as golf bag G' shown in FIG. 7, have a rim R' that is lower on one side than the others. The vertically adjustable structure of clip means 68 with respect to holder 20 allows the height of the golf club holder to first be adjusted above the bottom of the golf bag, then the clips are slid vertically within the slots 70 to meet the rim R, R' of the golf bag G, G', and then the screw 76 of clip means 68 can be tightened to secure the golf club holder 20 to the rim of the golf bag. Preferably, front slidable member portion 74 includes a recessed channel 78 into which rim R or R' is entrappingly received. As screw 76 is tightened, rim R or R' is entrappingly grabbed by slidable member portion 74 and slidable member portions 72 and 74 are drawn together so as to be frictionally retained within their slot 70 so as to secure golf club holder 20 to golf bag G or G' in a manner that will now be apparent.

Because, for example, the shaft of a "one iron" is approximately five inches (12.7 cm) longer than the shaft of a "nine iron", the vertical height of golf club holder 20 should preferably be adjusted so that the longest club, e.g., the "one iron", of those to be received into the wedge-shaped compartments is just above the floor of the golf bag G or G' when the club is inserted into the holder 20, and then the clip means 68 should be tightened, as heretofore described, to secure the holder 20 to the golf bag in that position.

Golf club holder 20 may additionally include one or more golf ball dispensing means 80 for retaining one or more golf balls B and dispensing the balls during play as required. In a first embodiment of golf ball dispensing means 80 shown in FIG. 8, one or more of the raised portions 38 has a blind bore 82 extending radially into sidewall portion 24, with bore 82 opening outwardly in a mouth 84, with bore 82 and mouth 84 being sized for receipt of one or more golf balls B therewithin. Because some modern golfers have begun using oversized golf balls, bore 82 and mouth 84 preferably should be sized to accommodate such larger, oversized balls as well. A compression spring 86 may be placed at the blind end 88 of bore 82 so as to urge the golf ball or balls B received within bore 82 toward mouth 84 for easy access by the golfer. The first embodiment of dispensing means 80 preferably includes a cover 90 pivotally mounted, as by using a rivet or screw 92, to sidewall portion 24 of golf club holder 20. Cover 90 is seen to be pivotally movable (see also FIGS. 6–7) between a first position 94, in which cover 90 blocks mouth 84 and thereby retains golf ball B within bore 82, and a second position 96, in which cover 90 unblocks and exposes mouth 84 and thereby allows a golf ball B within bore 82 to be expelled therefrom by spring 86. Cover 90 preferably has a felt backing 97 on its side adjacent sidewall portion 24 so as to reduce the frictional wear against sidewall portion 24 that might otherwise occur as cover 90 is pivoted between first and second positions 94 and 96, and also to reduce the noise of balls B impacting against the back side of cover 90 and further to reduce the noise as cover 90 is pivoted between first and second positions 94 and 96. Preferably cover 90 also includes a raised, molded finger grip 98 extending outwardly therefrom for gripping by the golfer as cover 90 is pivoted between first and second positions 94 and 96.

To use the first embodiment of golf ball dispensing means 80, the golfer would pre-load the dispenser 80 with one or more golf balls, first pivoting cover 90 to second position 96 and then pressing each golf ball B through mouth 84 and into bore 82, against spring 86, and then pivoting cover 90 back to first position 94 so as to retain golf ball B within bore 82. To retrieve the golf ball B from the first embodiment of golf ball dispensing means 80, the golfer grabs finger grip 98 and pivots cover 90 from first position 94 to second position 96, thereby allowing spring 86 to expel golf ball B through mouth 84. Cover 90 can then be pivoted back into first position 94 to cover mouth 84.

Figure 9:
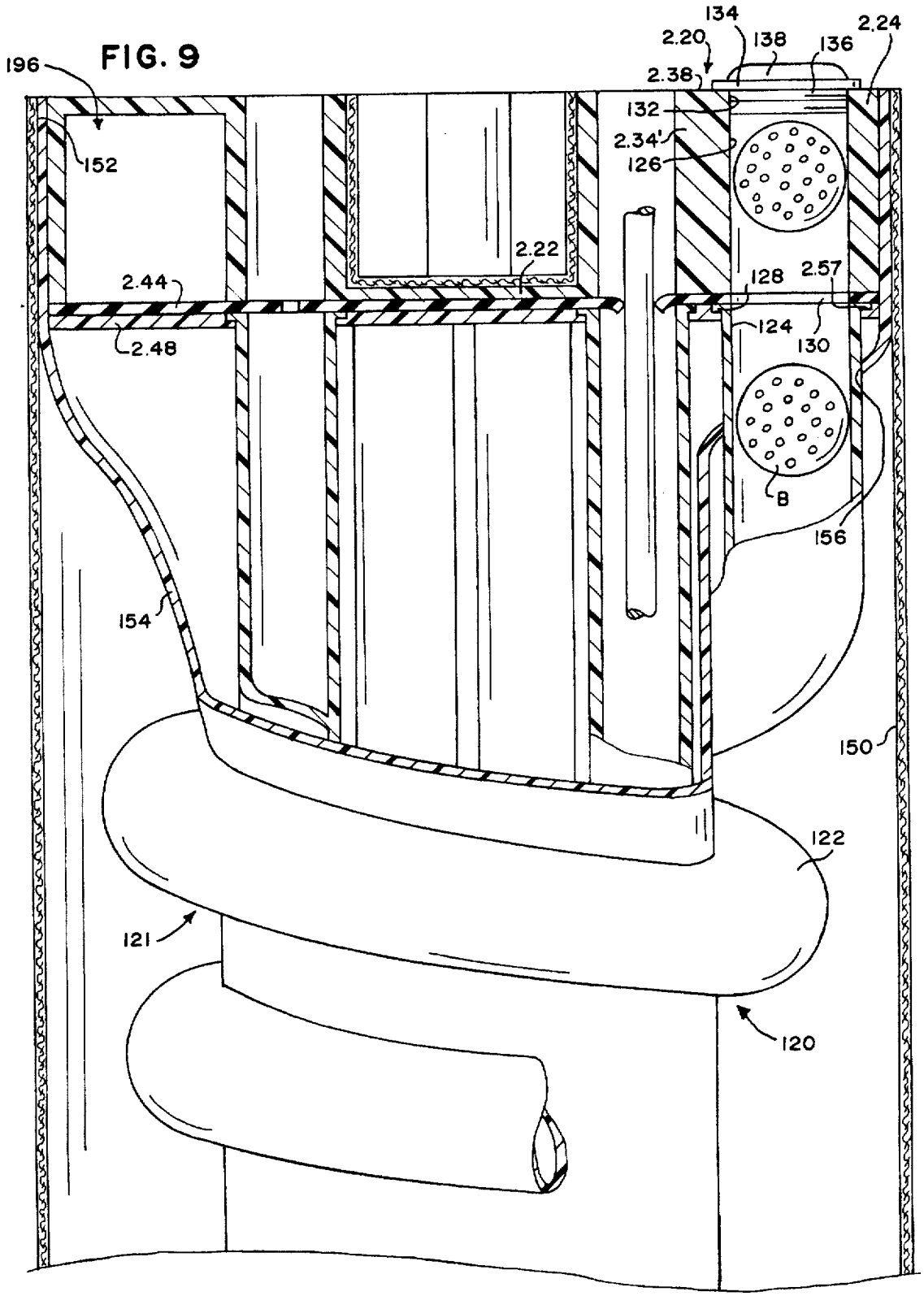
FIG. 9 is a sectional view of a second embodiment of the present invention, showing a portion of a second embodiment of the golf ball dispensing means.

FIGS. 9 and 10 show a second embodiment 2.20 of the present invention. Identifying reference designators for this second embodiment are marked similarly to the first embodiment, except with the prefix "2.". It shall be understood that many aspects of the two embodiments are substantially the same, and only the differences will be treated in detail, it being understood that similar structural features of the two embodiments perform similar functions.

Whereas the first embodiment 20 of the golf club holder, previously discussed, is adapted for insertion into and retrofitting of an existing golf bag G, the second embodiment 2.20 is for the combination of the holder 2.20 being permanently attached to a golf bag 150 that is designed to receive holder 2.20 without the clip means 68 of the first embodiment.

Unlike the first embodiment, the second embodiment 2.20 preferably has no cylindrical sleeve body 66, but instead, with this second embodiment, the golf bag 150 has an enlarged upper mouth 152 into which sidewall portion 2.24 is closely received, with the diameter of mouth 152 being substantially the same as the outer diameter of sidewall portion 2.24. Golf club holder 2.20 is preferably permanently secured to golf bag 150 as by a plurality of screws or rivets 190 inserted through bag 150 into sidewall portion 2.24. Preferably, golf bag 150 may have a bag liner 154 on the interior of bag 150 extending from the mouth 152 of bag 150 down to the interior bottom of the bag 150, with liner 154 preferably being closed at the bottom of the bag 150 and with the top of liner 154 being sandwichingly secured at the mouth 152 of bag 150 between sidewall portion 2.24 and bag 150.

Referring to FIGS. 9–11 and 15–17, the second embodiment 2.20 of the golf club holder may include a second embodiment 120 of a golf ball dispensing means. This second embodiment 120 of the golf ball dispensing means preferably comprises elongated tube means 121 for passing a plurality of golf balls therethrough, with this tube means preferably being a tubular member 122 that spirally encircles the exterior of liner 154. Tubular member 122 has a first end 124 that is substantially aligned with, and similarly sized to, an intake port 126 formed as a vertical bore through one of the raised platform portions 2.38 and enlarged divider walls 2.34' of second embodiment 2.20, with tubular member 122 preferably being secured between plate 2.48 and floor portion 2.22 of sidewall portion 2.24 in a manner similar to that previously described to secure the tubes 56 to plate 48, etc., i.e., with tubular member 122 preferably having a lip 128 therearound at first end 124 and with plate 2.48 having an upwardly-enlarged mouth 2.57 entrappingly receiving lip 128 therewithin. The inner diameters of tubular member 122 and intake port 126 are sized for loose fitting passage of a golf ball B therethrough, and grommet 2.44 has a similarly-sized opening 130 in alignment with intake port 126 and first end 124 of tubular member 122 through which the golf ball B can pass from port 126 to tubular member 122, it being understood that intake port 126 is in communication with first end 124 of tubular member 122. The upper end of intake port 126 preferably is internally threaded as by female threads 132 for threaded receipt of an intake plug 134, with intake plug 134 having external male threads 136 that are sized for mating threaded engagement with female threads 132. Intake plug 134 preferably has a raised finger grip 138 for gripping by the golfer so that intake plug 134 can be threadedly inserted into and removed from intake port 126 as desired.

Tubular member 122 further has a second end 140 remote from first end 124, and second end 140 is in communication with a dispensing port 142 through the wall of golf bag 150. The forces of gravity cause the golf balls B that are within tubular member 122 to move from upper first end 124 to lower second end 140 and the golf balls are then retrieved from dispensing port 142 as needed by the golfer during play in a manner hereinafter described. Because of the topological structure of the golf bag liner 154, as tubular member 122 encircles the liner 154 from first end 124 to second end 140, tubular member 122 penetrates liner 154 through an opening 156.

Figure 15:
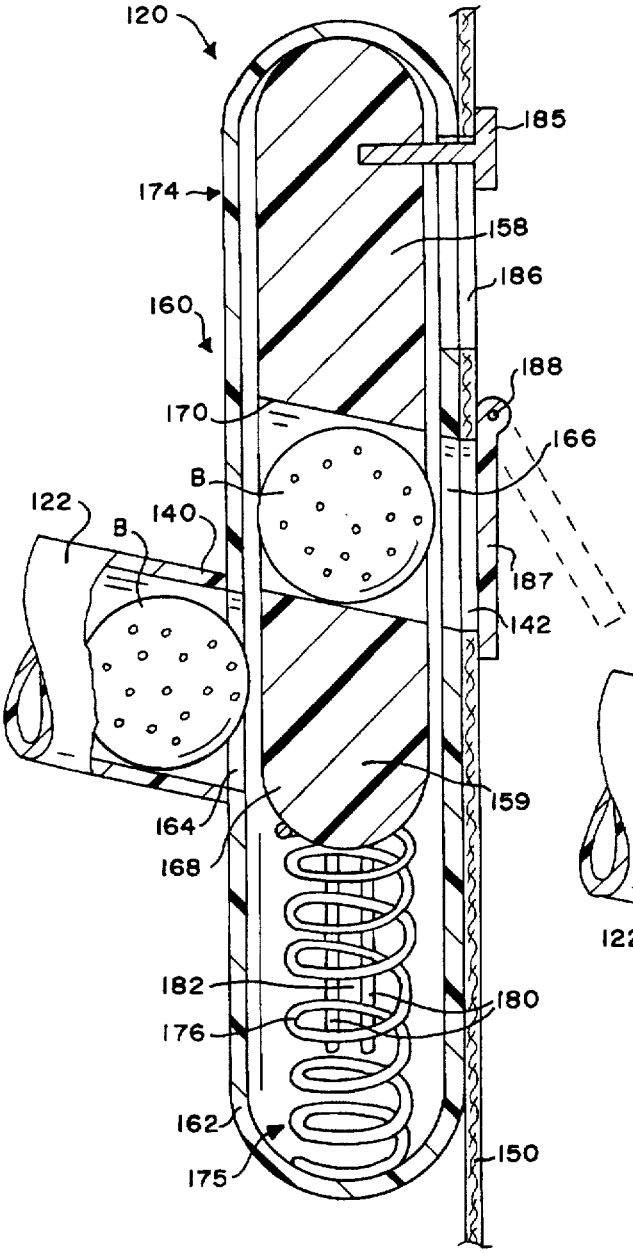
FIG. 15 is a sectional view of a portion of the second embodiment of the golf ball dispensing means, showing the reciprocating plug in a first position.
Figure 16:
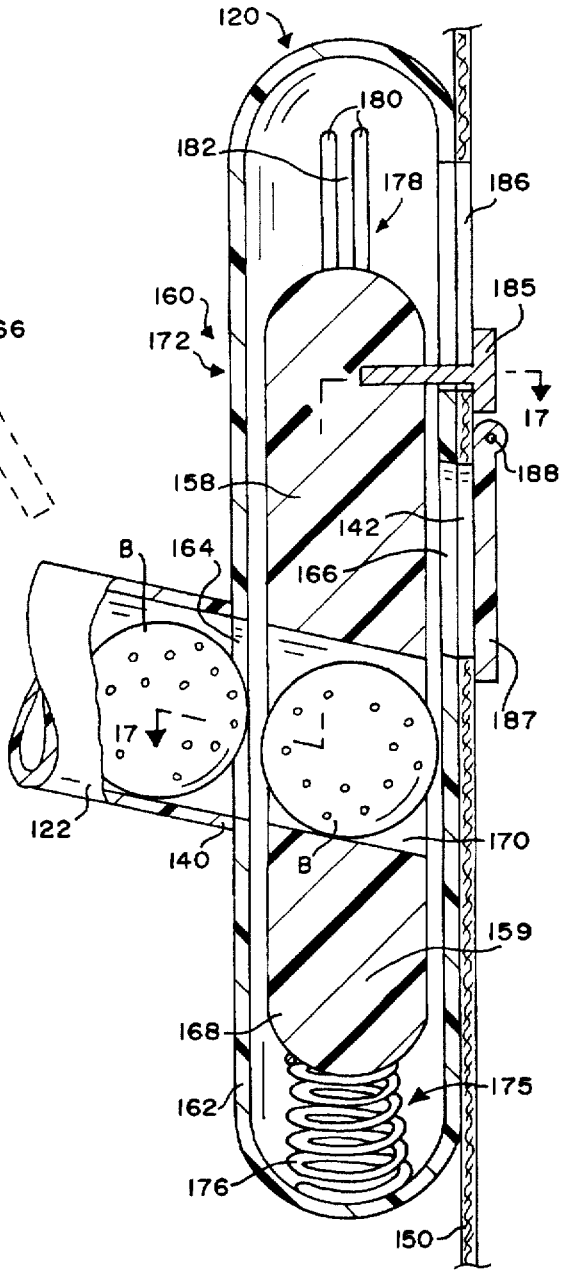
FIG. 16 is a sectional view of a portion of the second embodiment of the golf ball dispensing means, showing the reciprocating plug in a second position.

Referring to FIGS. 15–17, the second embodiment 120 of the golf ball dispensing means further comprises a dispensing mechanism 160 interposed between intake port 126 and dispensing port 142. Preferably, dispensing mechanism 160 includes a dispenser body 162 secured to the wall of golf bag 150 adjacent dispensing port 142, with dispenser body 162 preferably having a hollow interior that is generally oval in transverse cross section. Preferably, dispenser body 162 has a dispenser inlet opening 164 in substantial alignment with and in communication with second end 140 of tubular member 122, and also has a dispenser outlet opening 166 in substantial alignment with and in communication with dispensing port 142.

Moving and preferably vertically reciprocating within dispenser body 162 is a plug 168 having a transverse bore 170 therethrough. Like the slight downward incline of tubular member 122, transverse bore 170 also is inclined downward slightly along the path of the golf balls B. Plug 168 moves from a first position 172, shown in FIG. 16, to a second position 174, shown in FIG. 15. When plug 168 is in the first position 172 shown in FIG. 16, transverse bore 170 is in substantial alignment with both the second end 140 of tubular member 122 and dispenser inlet opening 164, and, simultaneously, transverse bore 170 is not in substantial alignment with, and is preferably blocking, both dispenser outlet opening 166 and dispensing port 142. When plug 168 is in the second position 174 shown in FIG. 15, transverse bore 170 is in substantial alignment with both dispenser outlet opening 166 and dispensing port 142, and, simultaneously, transverse bore 170 is not in substantial alignment with, and is preferably blocking, both the second end 140 of tubular member 122 and dispenser inlet opening 164. Also included in dispensing mechanism 160 is spring biasing means 175, such as compression spring 176 interposed between one end of plug 168 and the respective inner end of dispenser body 162, for urging plug 168 into one of first 172 and second 174 positions, preferably second position 174 as shown in FIG. 15.

Dispensing mechanism 160 also further preferably includes guide means 178 for constraining plug 168 from rotation as it reciprocates between first and second positions 172 and 174. Guide means 178 may include a pair of spaced apart vertical guide rails 180 projecting inwardly from the inner surface of dispenser body 162 so as to form a guide track 182, with one such guide track 182 on each of the opposite lateral sides of plug 168, and guide means 178 further includes a vertical guided rail 184 projecting outwardly from each of the opposite lateral sides of plug 168 and received into respective guide tracks 182 as shown in FIG. 17. Guide means 178 thus ensures proper alignment of transverse bore 170 with dispenser inlet opening 164 and dispenser outlet opening 166, and also thus with second end 140 of tubular member 122 and dispensing port 142, at either ends of the travel of plug 168 when plug 168 is in first and second positions 172 and 174.

As shown in FIGS. 15 and 16, the inner diameter of body 162, along the direction of travel of the golf balls B, is no smaller than, and preferably only slightly larger than, the diameter of a golf ball B, thereby allowing only a single golf ball to enter transverse bore 170 when plug 168 is in first position 172 shown in FIG. 16. If the inner diameter of body 162, along the direction of travel of the golf balls B, were to be greatly larger than the diameter of a golf ball B, then more than one golf ball B might be captured within transverse bore 170, thereby either binding the dispensing mechanism or dispensing more than one golf ball B. However, as seen in FIG. 17, plug 168 preferably has lateral portions 157 on either side of transverse bore 170, with lateral portions 157 joining upper portion 158 and lower portion 159 (see also FIG. 16) of plug 168 together, thereby making plug 168 have a larger diameter transverse to the direction of travel of the golf balls B than the diameter of plug 168 along the direction of travel of golf balls B.

Dispensing mechanism 160 also has a manually-operated slider 185 secured to plug 168 and extending through a slot 186 in dispenser body 162 and golf bag 150. By pushing down on slider 185, the golfer can cause plug 168 to move from second position 174 downward to first position 172 against the force of compression spring 176, thereby allowing a golf ball B to enter transverse bore 170 from tubular member 122 when plug 168 enters first position 172, and, upon releasing slider 185, plug 168, urged by spring 176, will lift the golf ball within transverse bore 170 to dispensing port 142 as the plug returns to second position 174.

The second embodiment 120 of the golf ball dispensing means preferably also includes a hinged door 187 for selectively covering dispensing port 142. Door 187 is hingeably mounted to golf bag 150, such as about a hinge axle 188, in a manner well-known to those skilled in the art, and may include a coiled spring, not shown but also well-known, about axle 188 for biasingly urging door 187 to its closed position over dispensing port 142.

To allow free movement of golf balls B through the second embodiment 120 of the golf ball dispensing means, the inner passageway diameters of intake port 126, tubular member 122, dispenser inlet opening 164, transverse bore 170, dispenser outlet opening 166, and dispensing port 142 are all sized larger than the outer diameter of golf balls B, with some additional added tolerance so as to ensure that no constriction of the golf balls B occurs along their path from intake port 126 to dispensing port 142. Like the first embodiment of the golf ball dispensing means, the second embodiment 120 may also have enlarged passageway diameters so as to accommodate the enlarged size of golf balls that some modern golfers prefer.

To use the second embodiment 120 of the golf ball dispensing means, the golfer simply removes intake plug 134 from intake port 126, inserts one or more golf balls B into the intake port 126, and allows the golf balls to travel under the forces of gravity down through tubular member 122 to dispensing mechanism 160. During play and when a new ball is needed, the golfer simply slides slider 185 downwardly to cause reciprocating plug 168 to receive a golf ball B from tubular member 122 and dispenser inlet opening 164 as heretofore described, and the golfer then releases slider 185, allows reciprocating plug 168 to raise the golf ball to the dispensing port 142, then lifts door 187 and retrieves the golf ball from dispensing port 142.

Preferably, both embodiments 20 and 2.20 of the golf club holder are moldedly constructed of well-known lightweight durable plastic material, and both embodiments may have various voids, e.g., voids 192, 194, 196 formed within sidewall portions 24, 2.24 so as to reduce the weight of the golf club holder.

To use either embodiment of the golf club holder, once the holder is secured to a golf bag as heretofore described, the golfer then selects those thirteen or fourteen clubs that will be used during a particular round of golf and then inserts the shafts of those clubs into the various holes and bores of the golf club holder as heretofore described with the shafts being received into the downwardly-extending tubes. Preferably the clubs will be inserted in clockwise numerical order so as to organize the clubs for quick selection during play, and the oversize clubs, i.e., the woods, drivers, etc., will have their shafts inserted into the vertical bores through the raised platforms of the holder, while the various irons and wedges will have their club heads received into the various wedge-shaped compartments formed within the sidewall portion. During play, the golfer simply selects a club, slides it vertically out of the holder, uses the club, and then replaces the club when the shot is completed.

Referring to FIGS. 12–14, either or both of first and second embodiments 20 and 2.20 of the invention may be provided with a cover 200 for protecting the golf clubs when they are received into the golf club holder. Cover 200, preferably having a lightweight and flexible plastic covering material 202, is generally hemispherical in shape and preferably has a plurality of circumferential well-known button snaps 204 for securing cover 200 to well-known button snap receptacles, not shown, around the outer periphery of circumferential sidewall portion 24, in the case of the first embodiment 20, or around the upper portion of golf bag 150 adjacent the golf bag mouth 152, in the case of the second embodiment 2.20. Cover 200 preferably has a well-known zipper 206 for closing the mouth opening 208 of cover 200, and a pair of semi-circular hinged metal reinforcements 210, 212 are provided at the lips of mouth opening 208 for reinforcing that opening 208. Reinforcements 210, 212 are preferably hinged at either end as by a pivoting hinge 214, thereby allowing mouth opening 208 to pivotingly hinge open as shown in FIG. 13 and to pivotingly hinge closed as shown in FIGS. 12 and 14. The golfer simply unzips zipper 206 and hinges open mouth opening 208 to access the clubs thereunder, and then closes mouth opening 208 and rezips zipper 206 to protect the clubs. If desired, the entire cover can be removed during play by unsnapping the snaps 204.

Although the present invention has been described and illustrated with respect to a preferred embodiment and a preferred use therefor, it is not to be so limited since modifications and changes can be made therein which are within the full intended scope of the invention.

I claim:

1. A golf club holder, said golf club holder comprising:

(a) a floor portion, said floor portion having a first plurality of holes therethrough and said floor portion having a substantially central axis; each hole of said first plurality of holes being sized for receipt of a shaft of a first golf club therethrough; and (b) a circumferential sidewall portion extending upwardly from said floor portion substantially concentric with said central axis, said circumferential sidewall portion having a second plurality of wedge-shaped compartments formed radially therewithin about said central axis; each said wedge-shaped compartment being shaped substantially as an annular sector about said central axis; each said wedge-shaped compartment being downwardly closed by said floor portion, each said wedge-shaped compartment having an open apex radially inward toward said central axis of said floor portion, and each said wedge-shaped compartment being upwardly open; said second plurality being no greater than said first plurality and the apex of each said wedge-shaped compartment being in substantial radial alignment with a different one hole of said first plurality of holes with each said different one hole of said first plurality of holes being external to its respective wedge-shaped compartment, each said wedge-shaped compartment being adapted for receiving a head of the first golf club therewithin when a shaft of the golf club is received into said different one hole in substantial radial alignment with its respective wedge-shaped compartment.

2. The golf club holder as recited in claim 1, in which said first plurality of holes are arranged in a four-row staggered pattern in which the first and fourth rows are staggeredly offset with respect to the second and third rows.

3. The golf club holder as recited in claim 1, in which said holder further includes resilient retaining means for retaining the shaft of the first golf club within each said hole of said first plurality of holes.

4. The golf club holder as recited in claim 3, in which said retaining means comprises a rubber grommet having a multiplicity of fingers extending into each said hole of said first plurality of holes.

5. The golf club holder as recited in claim 4, in which said golf club holder further comprises a plate secured to and below said floor portion, with said grommet being sandwiched between said plate and said floor portion.

6.The golf club holder as recited in claim 1, in which said golf club holder further comprises at least one tube extending downwardly from said floor portion and secured thereto in substantial axial alignment with one of said holes of said first plurality of holes.

7. The golf club holder as recited in claim 1, in which said golf club holder further comprises, respectively for each said hole of said first plurality of holes, a tube extending downwardly from said floor portion and secured thereto in substantial axial alignment with said each said hole of said first plurality of holes.

8. The golf club holder as recited in claim 7, in which said golf club holder further comprises:

(a) a rubber grommet having a multiplicity of fingers extending into each said hole of said first plurality of holes; and (b) a plate secured to and below said floor portion, and each respective said tube has an outwardly-extending lip therearound, said grommet being sandwiched between said plate and said floor portion; said plate having, respectively for each said hole of said first plurality of holes, an orifice therethrough in substantial alignment with its respective said hole of said first plurality of holes, each respective said orifice having an upwardly-enlarged mouth entrappingly receiving said lip of its respective said tube.

9. The golf club holder as recited in claim 1, in which said golf club holder further comprises golf ball dispensing means for retaining and selectively dispensing a golf ball, said circumferential sidewall portion having a blind bore thereinto, said blind bore having a mouth, said golf ball dispensing means comprising:

(a) compression spring means within said blind bore for urging a ball from said blind bore, and (b) cover means for selectively covering said mouth, said cover means having a first position in which said mouth is blocked and having a second position in which said mouth is unblocked.

10. In combination, (a) a golf club holder, said golf club holder comprising:

i. a floor portion, said floor portion having a first plurality of holes therethrough and said floor portion having a substantially central axis; each hole of said first plurality of holes being sized for receipt of a shaft of a first golf club therethrough; and ii. a circumferential sidewall portion extending upwardly from said floor portion substantially concentric with said central axis, said circumferential sidewall portion having a second plurality of wedge-shaped compartments formed radially therewithin about said central axis; each said wedge-shaped compartment being shaped substantially as an annular sector about said central axis; each said wedge-shaped compartment being downwardly closed by said floor portion, each said wedge-shaped compartment having an open apex radially inward toward said central axis of said floor portion, and each said wedge-shaped compartment being upwardly open; said second plurality being no greater than said first plurality and the apex of each said wedge-shaped compartment being in substantial radial alignment with a different one hole of said first plurality of holes, each said wedge-shaped compartment being adapted for receiving a head of the first golf club therewithin when a shaft of the golf club is received into said different one hole in substantial radial alignment with its respective wedge-shaped compartment; and (b) a golf bag, said golf bag having a mouth, said golf club holder being fixedly received within said mouth, said golf club holder and golf bag combination additionally comprising golf ball dispensing means for retaining and selectively dispensing a golf ball of a plurality of golf balls, said golf ball dispensing means comprising:

i. elongated tube means for passing a plurality of golf balls therethrough, said elongated tube means having a first end and having a second end; said golf ball dispensing means having an intake port formed within said golf club holder, said intake port being in communication with said first end of said elongated tube means; said golf ball dispensing means having a dispensing port through said golf bag, said dispensing port being in communication with said second end of said elongated tube means; and ii. a dispensing mechanism interposed between said intake port and said dispensing port, said dispensing mechanism comprising:

(A) a moving plug having a transverse bore therethrough; said moving plug having a first position in which said transverse bore is in substantial alignment with said second end of said elongated tube means and in which said transverse bore is not in substantial alignment with said dispensing port; said moving plug having a second position in which said transverse bore is in substantial alignment with said dispensing port and in which said transverse bore is not in substantial alignment with said second end of said elongated tube means; and (B) spring biasing means for urging said moving plug into one of said first and said second positions.

11. The golf club holder and golf bag combination as recited in claim 10, in which said moving plug reciprocates between said first and said second positions and said spring biasing means urges said moving plug into said second position, and said dispensing mechanism further comprises guide means for constraining said moving plug from rotation as said moving plug reciprocates between said first and said second positions.

12. A golf club holder, said golf club holder comprising:

(a) a floor portion, said floor portion having a first plurality of holes therethrough and said floor portion having a substantially central axis; each hole of said first plurality of holes being sized for receipt of a shaft of a first golf club therethrough; and (b) a circumferential sidewall portion extending upwardly from said floor portion substantially concentric with said central axis, said circumferential sidewall portion having a second plurality of wedge-shaped compartments formed radially therewithin about said central axis; each said wedge-shaped compartment being downwardly closed by said floor portion, each said wedge-shaped compartment having an open apex radially inward toward said central axis of said floor portion, and each said wedge-shaped compartment being upwardly open; said second plurality being no greater than said first plurality and the apex of each said wedge-shaped compartment being in substantial radial alignment with a different one hole of said first plurality of holes with each said different one hole of said first plurality of holes being external to its respective wedge-shaped compartment, each said wedge-shaped compartment being adapted for receiving a head of the first golf club therewithin when a shaft of the golf club is received into said different one hole in substantial radial alignment with its respective wedge-shaped compartment; said sidewall portion including a third plurality of raised platform portions interposed between some of said wedge-shaped compartments, each said raised platform portion having a substantially vertical bore therethrough, said vertical bore being sized for receipt of a shaft of a second golf club therethrough.

13. The golf club holder as recited in claim 12, in which said golf club holder further includes resilient retaining means for retaining the shaft of the first golf club selectively within each said hole of said first plurality of holes.

14. The golf club holder as recited in claim 13, in which said retaining means comprises a rubber grommet having a multiplicity of fingers extending into each said hole of said first plurality of holes.

15. The golf club holder as recited in claim 14, in which said golf club holder further comprises a plate secured to and below said floor portion, with said grommet being sandwiched between said plate and said floor portion.

16. The golf club holder as recited in claim 12, in which said golf club holder further includes resilient retaining means for retaining the shaft of the first golf club selectively within each said hole of said first plurality of holes and for retaining the shaft of the second golf club selectively within each said vertical bore, said retaining means comprising a rubber grommet having a multiplicity of fingers extending into each said hole of said first plurality of holes and into each said vertical bore.

17. The golf club holder as recited in claim 16, in which said golf club holder further comprises a plate secured to and below said floor portion, with said grommet being sandwiched between said plate and said floor portion.

18. The golf club holder as recited in claim 12, in which said golf club holder further comprises at least one tube extending downwardly from said floor portion and secured thereto in substantial axial alignment with one of said holes of said first plurality of holes.

19. The golf club holder as recited in claim 12, in which said golf club holder further comprises, respectively for each said hole of said first plurality of holes, a tube extending downwardly from said floor portion and secured thereto in substantial axial alignment with said each said hole of said first plurality of holes.

20. The golf club holder as recited in claim 19, in which said golf club holder further comprises:

(a) a rubber grommet having a multiplicity of fingers extending into each said hole of said first plurality of holes; and (b) a plate secured to and below said floor portion, and each respective said tube has an outwardly-extending lip therearound, said grommet being sandwiched between said plate and said floor portion; said plate having, respectively for each said hole of said first plurality of holes, an orifice therethrough in substantial alignment with its respective said hole of said first plurality of holes, each respective said orifice having an upwardly-enlarged mouth entrappingly receiving said lip of its respective said tube.

21. The golf club holder as recited in claim 20, in which said golf club holder further comprises clip means, vertically adjusted with respect to said golf club holder and secure thereto, for securing said golf club holder to a rim of a golf bag.

22. The golf club holder as recited in claim 12, in which said golf club holder further comprises golf ball dispensing means for retaining and selectively dispensing a golf ball, said circumferential sidewall portion having a blind bore thereinto, said blind bore having a mouth, said golf ball dispensing means comprising:

(a) compression spring means within said blind bore for urging a ball from said blind bore, and (b) cover means for selectively covering said mouth, said cover means having a first position in which said mouth is blocked and having a second position in which said mouth is unblocked.

23. In combination, (a) a golf club holder, said golf club holder comprising:

i. a floor portion, said floor portion having a first plurality of holes therethrough and said floor portion having a substantially central axis; each hole of said first plurality of holes being sized for receipt of a shaft of a first golf club therethrough; and ii. a circumferential sidewall portion extending upwardly from said floor portion substantially concentric with said central axis, said circumferential sidewall portion having a second plurality of wedge-shaped compartments formed radially therewithin about said central axis; each said wedge-shaped compartment being downwardly closed by said floor portion, each said wedge-shaped compartment having an open apex radially inward toward said central axis of said floor portion, and each said wedge-shaped compartment being upwardly open; said second plurality being no greater than said first plurality and the apex of each said wedge-shaped compartment being in substantial radial alignment with a different one hole of said first plurality of holes, each said wedge-shaped compartment being adapted for receiving a head of the first golf club therewithin when a shaft of the golf club is received into said different one hole in substantial radial alignment with its respective wedge-shaped compartment; said sidewall portion including a third plurality of raised platform portions interposed between some of said wedge-shaped compartments, each said raised platform portion having a substantiallv vertical bore therethrough, said vertical bore being sized for receipt of a shaft of a second golf club therethrough; and (b) a golf bag, said golf bag having a mouth, said golf club holder being fixedly received within said mouth, said golf club holder and golf bag combination additionally comprising golf ball dispensing means for retaining and selectively dispensing a golf ball of a plurality of golf balls, said golf ball dispensing means comprising:

i. elongated tube means for passing a plurality of golf balls therethrough, said elongated tube means having a first end and having a second end; said golf ball dispensing means having an intake port formed within said golf club holder, said intake port being in communication with said first end of said elongated tube means; said golf ball dispensing means having a dispensing port through said golf bag, said dispensing port being in communication with said second end of said elongated tube means;

ii. a dispensing mechanism interposed between said intake port and said dispensing port, said dispensing mechanism comprising:

(A) a moving plug having a transverse bore therethrough; said moving plug having a first position in which said transverse bore is in substantial alignment with said second end of said elongated tube means and in which said transverse bore is not in substantial alignment with said dispensing port; said moving plug having a second position in which said transverse bore is in substantial alignment with said dispensing port and in which said transverse bore is not in substantial alignment with said second end of said elongated tube means;and (B) spring biasing means for urging said moving plug into one of said first and said second positions.

24. The golf club holder and golf bag combination as recited in claim 23, in which said moving plug reciprocates between said first and said second positions and said spring biasing means urges said moving plug into said second position, and said dispensing mechanism further comprises guide means for constraining said moving plug from rotation as said moving plug reciprocates between said first and said second positions.

25. A golf club holder, said golf club holder comprising:

(a) a floor portion, said floor portion having a first plurality of holes therethrough and said floor portion having a substantially central axis; each hole of said first plurality of holes being sized for receipt of a shaft of a first golf club therethrough;

(b) a circumferential sidewall portion extending upwardly from said floor portion substantially concentric with said central axis, said circumferential sidewall portion having a second plurality of wedge-shaped compartments formed radially therewithin about said central axis; each said wedge-shaped compartment being shaped substantially as an annular sector about said central axis; each said wedge-shaped compartment being downwardly closed by said floor portion, each said wedge-shaped compartment having an open apex radially inward toward said central axis of said floor portion, and each said wedge-shaped compartment being upwardly open; said second plurality being no greater than said first plurality and the apex of each said wedge-shaped compartment being in substantial radial alignment with a different one hole of said first plurality of holes, each said wedge-shaped compartment being adapted for receiving a head of the first golf club therewithin when a shaft of the golf club is received into said different one hole in substantial radial alignment with its respective wedge-shaped compartment; said sidewall portion including a third plurality of raised platform portions interposed between some of said wedge-shaped compartments, each said raised platform portion having a substantially vertical bore therethrough, said vertical bore being sized for receipt of a shaft of a second golf club therethrough;

(c) respectively for each said hole of said first plurality of holes and for each said vertical bore, a tube extending downwardly from said floor portion in substantial axial alignment with its respective said hole or vertical bore, each respective said tube having an outwardly-extending lip therearound;

(d) a rubber grommet having a multiplicity of fingers extending into each said hole of said first plurality of holes and extending into each said vertical bore;

(e) a plate secured to and below said floor portion, with said grommet being sandwiched between said plate and said floor portion; said plate having, respectively for each said hole of said first plurality of holes and for each said vertical bore, an orifice therethrough in substantial alignment with its respective hole or vertical bore, each respective said orifice having an upwardly-enlarged mouth entrappingly receiving said lip of its respective said tube.

26. The golf club holder as recited in claim 25, in which said first plurality of holes and said vertical bores are arranged in a four-row staggered pattern in which the first and fourth rows are staggeredly offset with respect to the second and third rows.

27. The golf club holder as recited in claim 25, in which said golf club holder further comprises clip means, vertically adjustable with respect to said golf club holder and secured thereto, for securing said golf club holder to a rim of a golf bag.

28. In combination with the golf club holder as recited in claim 25, a golf bag, said golf bag having a mouth, said golf club holder being fixedly received within said mouth, said golf club holder and golf bag combination additionally comprising golf ball dispensing means for retaining and selectively dispensing a golf ball of a plurality of golf balls, said golf ball dispensing means comprising:

(a) elongated tube means for passing a plurality of golf balls therethrough, said elongated tube means having a first end and having a second end; said golf ball dispensing means having an intake port formed within said golf club holder, said intake port being in communication with said first end of said elongated tube means; said golf ball dispensing means having a dispensing port through said golf bag, said dispensing port being in communication with said second end of said elongated tube means;

(b) a dispensing mechanism interposed between said intake port and said dispensing port, said dispensing mechanism comprising:

i. a moving plug having a transverse bore therethrough; said moving plug having a first position in which said transverse bore is in substantial alignment with said second end of said elongated tube means and in which said transverse bore is not in substantial alignment with said dispensing port; said moving plug having a second position in which said transverse bore is in substantial alignment with said dispensing port and in which said transverse bore is not in substantial alignment with said second end of said elongated tube means ii. spring biasing means for urging said moving plug into one of said first and said second positions.

29. The golf club holder and golf bag combination as recited in claim 28, in which said moving plug reciprocates between said first and said second positions and said spring biasing means urges said moving plug into said second position, and said dispensing mechanism further comprises guide means for constraining said moving plug from rotation as said moving plug reciprocates between said first and said second positions.

* * * * *